US006989497B1

(12) United States Patent
Lee

(10) Patent No.: US 6,989,497 B1
(45) Date of Patent: Jan. 24, 2006

(54) ROCKER LEVER ASSEMBLY

(75) Inventor: Mei-Hsiu Lee, Taichung (TW)

(73) Assignee: Taiwan PWL Corporation, Taoyuan (TW)

( * ) Notice: Subject to any disclaimer, the term of this patent is extended or adjusted under 35 U.S.C. 154(b) by 0 days.

(21) Appl. No.: 10/895,678

(22) Filed: Jul. 22, 2004

(51) Int. Cl.
*H01H 25/04* (2006.01)

(52) U.S. Cl. ..... 200/6 A

(58) Field of Classification Search ..... 200/4, 200/6 A; 338/128–132, 153–215
See application file for complete search history.

(56) References Cited

U.S. PATENT DOCUMENTS 4,245,137 A * 1/1981 Hirai et al. ..... 200/4
5,068,499 A * 11/1991 Kuratani ..... 200/6 A
6,078,247 A * 6/2000 Shimomura ..... 338/131
6,140,907 A * 10/2000 Liu ..... 338/160
6,150,919 A * 11/2000 Shimomura ..... 338/128
6,369,691 B1 * 4/2002 Chiu ..... 338/172
6,429,767 B1 * 8/2002 Shimomura ..... 338/128
6,504,115 B2 * 1/2003 Nakai ..... 200/6 A
6,538,639 B1 * 3/2003 Takahashi ..... 200/6 A

* cited by examiner

*Primary Examiner*—Michael A. Friedhofer
(74) *Attorney, Agent, or Firm*—Alan D. Kamrath; Nikolai & Mersereau, P.A.

(57) ABSTRACT

A rocker lever assembly includes a housing, an operation device, a switch device, a restoring device, and two sensing variable resistors. The operation device includes a first pivot seat, a second pivot seat, and a control lever. The switch device includes a base, a contact terminal, a contact plate, and a cover plate. The control lever is depressed to cause the under surface of the second pivot seat to depress the cover plate. Thus, the switch device is hidden in the housing, thereby reducing the volume of the rocker lever assembly. In addition, the contact slide is moved on the resistance plate of the casing by guidance of the drive member, thereby greatly enhancing the sensitivity of each of the two sensing variable resistors.

18 Claims, 3 Drawing Sheets

ROCKER LEVER ASSEMBLY

BACKGROUND OF THE INVENTION

1. Field of the Invention

The present invention relates to a rocker lever assembly, and more particularly to a rocker lever assembly available for controlling the navigation direction or data change of a personal digital product, such as the PDA, video game, cell phone, portable computer or the like.

2. Description of the Related Art

A conventional rocker lever comprises a housing, an operation device mounted in the housing, a switch device mounted on an outside of the housing, a restoring device mounted in the housing, and two variable resistors mounted on an outside of the housing. The operation device includes a first pivot seat pivotable in a longitudinal direction, a second pivot seat pivotable in a transverse direction perpendicular to that of the first pivot seat, and a control lever movable in the longitudinal direction and the transverse direction to pivot the first pivot seat and the second pivot seat in the longitudinal direction and the transverse direction respectively. When in use, the conventional rocker lever is available for controlling the navigation direction or data change of a personal digital product, such as the PDA, video game, cell phone, portable computer or the like.

However, the switch device mounted on the outside of the housing, so that the conventional rocker lever has a larger volume, thereby increasing costs in package, storage and transportation.

SUMMARY OF THE INVENTION

In accordance with the present invention, there is provided a rocker lever assembly, comprising:

a housing;

an operation device mounted in the housing and including a first pivot seat pivotally mounted in the housing, a second pivot seat pivotally mounted in the housing and located under the first pivot seat, and a control lever mounted on the first pivot seat and the second pivot seat to pivot the first pivot seat and the second pivot seat; and a switch device mounted in the housing and including:

a base mounted in the housing and having an inside formed with a circular recess having a bottom formed with an annular protruding flange;

a contact terminal embedded in the flange of the base and including two spaced first contact points exposed from the flange of the base and a second contact point located between the first contact points and exposed from the flange of the base;

a contact plate flexibly mounted in the flange of the base and having a periphery rested on the first contact points of the contact terminal and a central portion spaced from the second contact point of the contact terminal; and a cover plate mounted on the flange of the base and having a central portion formed with an elastic press piece rested on the central portion of the contact plate to press the central portion of the contact plate to contact the second contact point of the contact terminal.

The primary objective of the present invention is to provide a rocker lever assembly, wherein the spring has a first end mounted on the mounting seat of the urging race and a second end mounted on the flange of the base, so that the volume of the rocker lever assembly is reduced largely.

Another objective of the present invention is to provide a rocker lever assembly, wherein the contact slide is displaced on the resistance plate of the casing by guidance of the drive member, thereby greatly enhancing the sensitivity of each of the two sensing variable resistors.

A further objective of the present invention is to provide a rocker lever assembly, wherein the first pivot seat and the second pivot seat are made of wear-resistant material, thereby enhancing the lifetime of the operation device.

A further objective of the present invention is to provide a rocker lever assembly, wherein the switch device is hidden in the housing, thereby reducing the volume of the rocker lever assembly.

Further benefits and advantages of the present invention will become apparent after a careful reading of the detailed description with appropriate reference to the accompanying drawings.

DETAILED DESCRIPTION OF THE INVENTION

Figure 1:
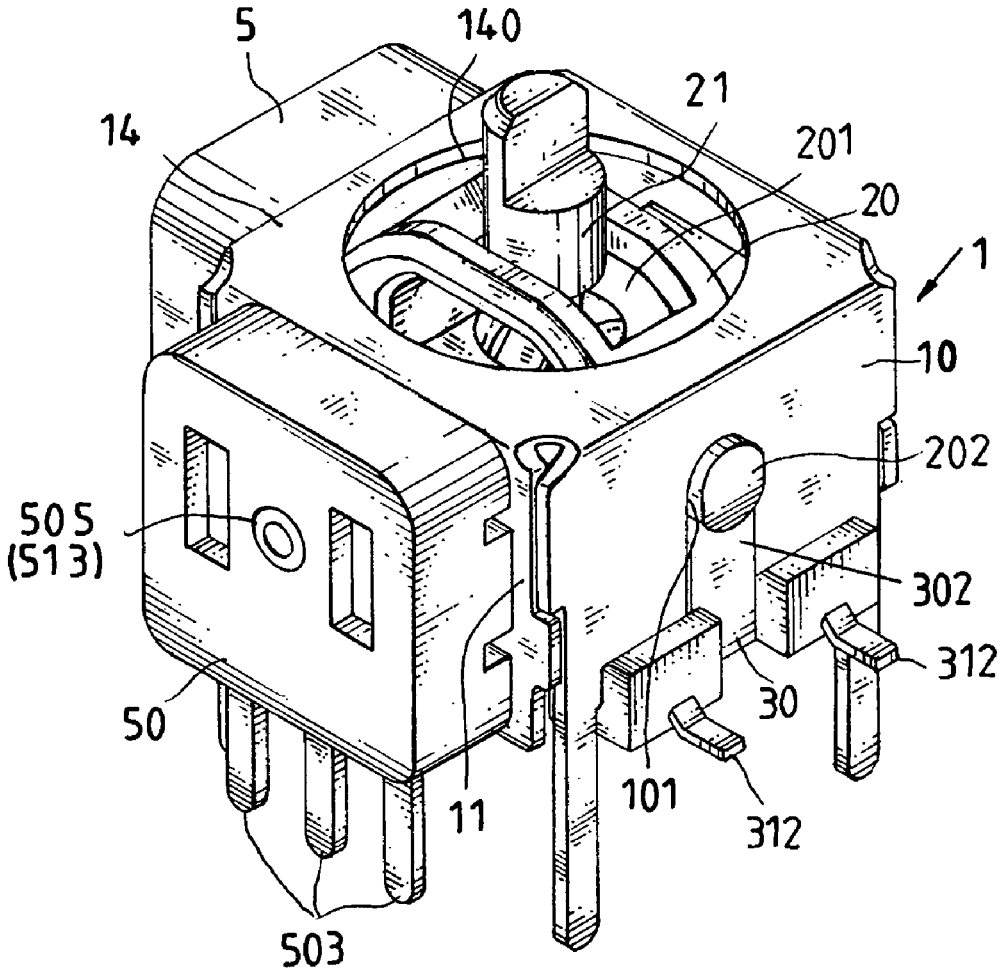
FIG. 1 is a perspective view of a rocker lever assembly in accordance with the preferred embodiment of the present invention.
Figure 2:
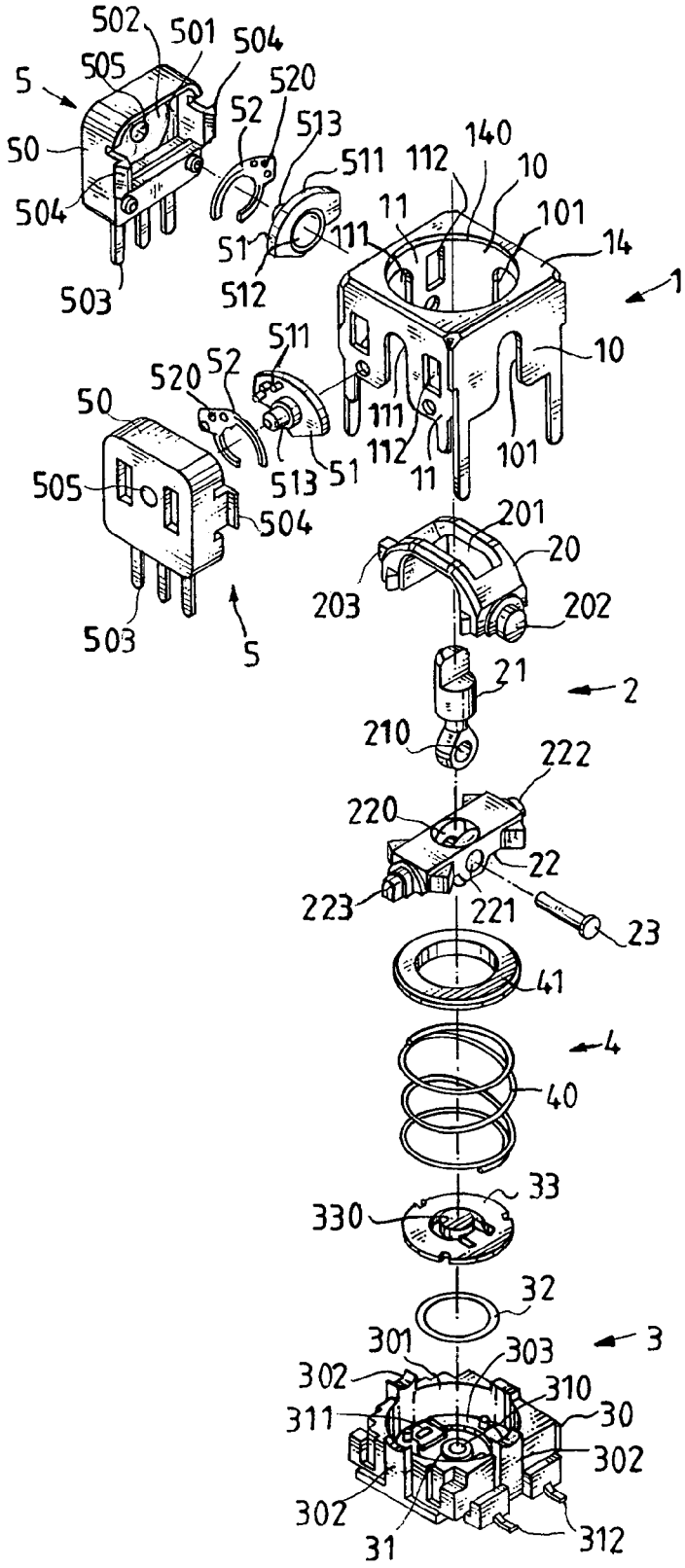
FIG. 2 is an exploded perspective view of the rocker lever assembly as shown in FIG. 1.
Figure 3:
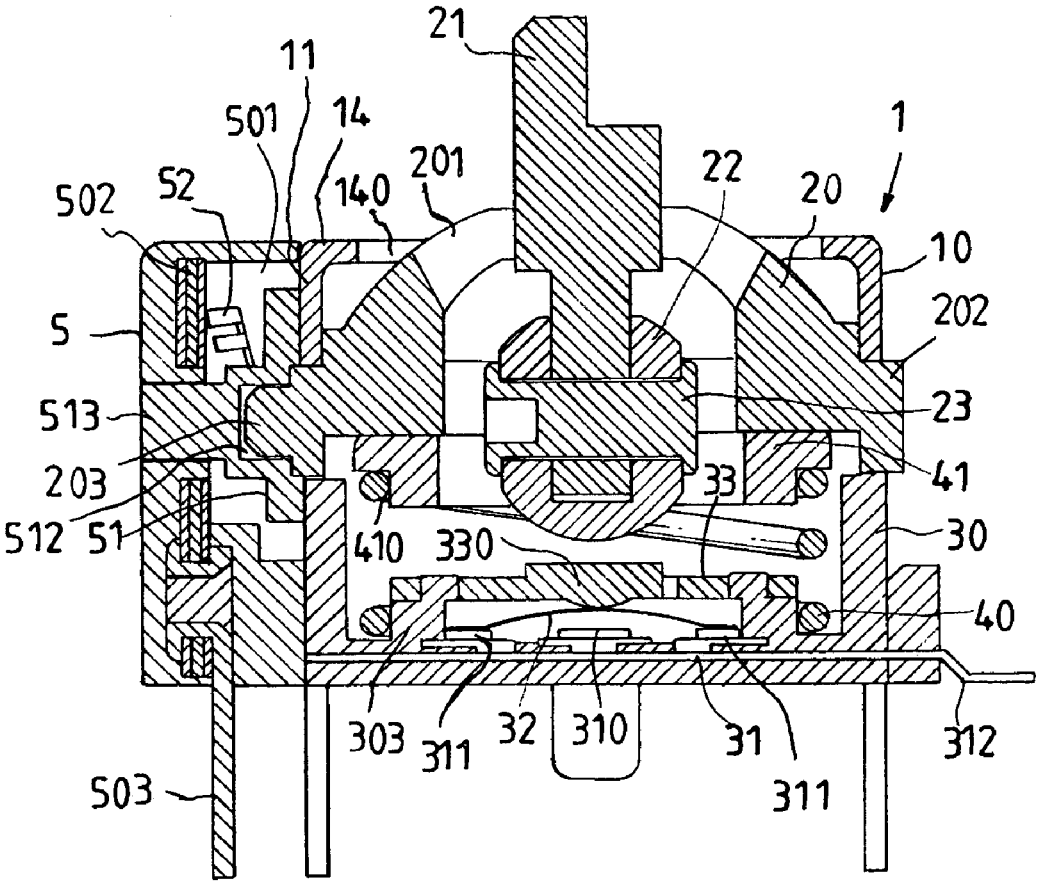
FIG. 3 is a plan cross-sectional view of the rocker lever assembly as shown in FIG. 1.

Referring to FIGS. 1–3, a rocker lever assembly in accordance with the preferred embodiment of the present invention comprises a housing 1, an operation device 2, a switch device 3, a restoring device 4, and two sensing variable resistors 5.

The housing 1 is hollow and includes a top plate 14, two adjacent first side plates 10, and two adjacent second side plates 11.

The top plate 14 of the housing 1 is formed with an operation hole 140.

Each of the two first side plates 10 of the housing 1 is bendable and is formed with an opening 101 facing downward.

Each of the two second side plates 11 of the housing 1 is bendable and is formed with an opening 111 facing downward. Each of the two second side plates 11 of the housing 1 is formed with two spaced locking holes 112.

The operation device 2 is mounted in the housing 1 and includes a first pivot seat 20, a second pivot seat 22, and a control lever 21.

The first pivot seat 20 of the operation device 2 has an arch shape and is pivotally mounted in the housing 1. The first pivot seat 20 of the operation device 2 has an inside formed with a guide slot 201 and has a first end formed with a first pivot shaft 202 pivotally mounted in the opening 101 of a first one of the two first side plates 10 of the housing 1 and a second end formed with a second pivot shaft 203 pivotally mounted in the opening 111 of a first one of the two second side plates 11 of the housing 1.

The second pivot seat 22 of the operation device 2 is pivotally mounted in the housing 1 and is located under the first pivot seat 20. The second pivot seat 22 of the operation device 2 is rotatable along a direction perpendicular to that of the first pivot seat 20. The second pivot seat 22 of the operation device 2 has an inside formed with a receiving chamber 220 and has two side walls formed with two shaft holes 221 each communicating with the receiving chamber 220. The second pivot seat 22 of the operation device 2 has a first end formed with a first pivot axle 222 pivotally mounted in the opening 101 of a second one of the two first side plates 10 of the housing 1 and a second end formed with a second pivot axle 223 pivotally mounted in the opening 111 of a second one of the two second side plates 11 of the housing 1.

The control lever 21 of the operation device 2 is mounted on the first pivot seat 20 and the second pivot seat 22 to pivot the first pivot seat 20 and the second pivot seat 22. The control lever 21 of the operation device 2 is slidably mounted in the guide slot 201 of the first pivot seat 20 and has a first end protruding outward from the guide slot 201 of the first pivot seat 20. The control lever 21 of the operation device 2 has a second end pivotally mounted in the receiving chamber 220 of the second pivot seat 22 and formed with a pivot hole 210. A pivot pin 23 is extended through the two shaft holes 221 of the second pivot seat 22 and the pivot hole 210 of the control lever 21, so that the control lever 21 is pivotally mounted on the second pivot seat 22.

In such a manner, the control lever 21 of the operation device 2 is driven to move in two perpendicular directions, so that the first pivot seat 20 and the second pivot seat 22 are driven by the control lever 21 to rotate in two perpendicular directions respectively.

The switch device 3 is mounted in the housing 1 and includes a base 30, a contact terminal 31, a contact plate 32, and a cover plate 33.

The base 30 of the switch device 3 is mounted in the housing 1 and has an inside formed with a circular recess 301. The base 30 of the switch device 3 has a peripheral wall formed with four opposite support studs 302 for supporting the first pivot shaft 202 and second pivot shaft 203 of the first pivot seat 20 and the first pivot axle 222 and second pivot axle 223 of the second pivot seat 22. The circular recess 301 of the base 30 of the switch device 3 has a bottom formed with an annular protruding flange 303.

The contact terminal 31 of the switch device 3 is embedded in the flange 303 of the base 30 and has a side protruding outward from the base 30 and formed with two spaced SMD solder legs 312. The contact terminal 31 of the switch device 3 is integrally coated by the flange 303 of the base 30. The contact terminal 31 of the switch device 3 includes two spaced first contact points 311 exposed from the flange 303 of the base 30 and a second contact point 310 located between the first contact points 311 and exposed from the flange 303 of the base 30.

The contact plate 32 of the switch device 3 is flexibly mounted in the flange 303 of the base 30 and has a periphery rested on the first contact points 311 of the contact terminal 31 and a dome-shaped central portion spaced from the second contact point 310 of the contact terminal 31.

The cover plate 33 of the switch device 3 is mounted on the flange 303 of the base 30 and has a central portion formed with an elastic press piece 330 rested on the central portion of the contact plate 32 to press the central portion of the contact plate 32 to contact the second contact point 310 of the contact terminal 31.

The restoring device 4 is mounted in the housing 1 and includes an urging race 41 rested on a bottom of the first pivot seat 20 of the operation device 2, and a spring 40 urged between the urging race 41 and the base 30 of the switch device 3. The urging race 41 of the restoring device 4 has a side formed with a protruding mounting seat 410 (see FIG. 3), and the spring 40 has a first end mounted on the mounting seat 410 of the urging race 41 and a second end mounted on the flange 303 of the base 30.

Each of the two sensing variable resistors 5 is mounted on the housing 1 and includes a casing 50, a drive member 51, and a contact slide 52.

The casing 50 of each of the two sensing variable resistors 5 is secured on a respective one of the two second side plates 11 of the housing 1. The casing 50 of each of the two sensing variable resistors 5 has an inside formed with a mounting recess 501 integrally formed with a printing carbon film type resistance plate 502 having a printing track. The resistance plate 502 of each of the two sensing variable resistors 5 has three terminal legs 503 protruding outward from the casing 50 for mounting the rocker lever assembly to other circuit board (not shown). The casing 50 of each of the two sensing variable resistors 5 is formed with two spaced hook-shaped elastic insertion legs 504 each snapped into and locked in a respective one of the locking holes 112 of the respective second side plate 11 of the housing 1. The casing 50 of each of the two sensing variable resistors 5 has a side formed with a mounting hole 505.

The drive member 51 of each of the two sensing variable resistors 5 is rotatably mounted in the casing 50 and secured on a respective one of the second pivot shaft 203 of the first pivot seat 20 and the second pivot axle 223 of the second pivot seat 22 to rotate therewith. The drive member 51 of each of the two sensing variable resistors 5 has a first side formed with a counterbore 512 mounted on a respective one of the second pivot shaft 203 of the first pivot seat 20 and the second pivot axle 223 of the second pivot seat 22 and a second side formed with a support shaft 513 rotatably mounted in the mounting hole 505 of the casing 50. The second side of the drive member 51 of each of the two sensing variable resistors 5 has a periphery formed with a plurality of protruding stubs 511.

The contact slide 52 of each of the two sensing variable resistors 5 is secured on the drive member 51 to rotate therewith and is movably mounted on the resistance plate 502 of the casing 50 along a curved track. The contact slide 52 of each of the two sensing variable resistors 5 has a substantially crescent shape and has a periphery formed with a plurality of through holes 520 mounted on the protruding stubs 511 of the drive member 51.

In operation, when the control lever 21 of the operation device 2 is moved in the operation hole 140 of the top plate 14 of the housing 1, the first pivot seat 20 is driven by the control lever 21 to pivot about the first pivot shaft 202 and the second pivot shaft 203 of the first pivot seat 20, and the second pivot seat 22 is driven by the control lever 21 to pivot about the first pivot axle 222 and the second pivot axle 223 of the second pivot seat 22, so that when the control lever 21 of the operation device 2 is driven to move in two perpendicular directions, the first pivot seat 20 and the second pivot seat 22 are driven by the control lever 21 to rotate in two perpendicular directions respectively.

At this time, the drive member 51 of each of the two sensing variable resistors 5 is rotated by a respective one of the second pivot shaft 203 of the first pivot seat 20 and the second pivot axle 223 of the second pivot seat 22 to rotate the contact slide 52 which is displaced on the resistance plate 502 of the casing 50 along a curved track, so that the impedance of the resistance plate 502 of the casing 50 is changed so as to change the voltage. In such a manner, the terminal legs 503 of the resistance plate 502 of each of the two sensing variable resistors 5 output the changed voltage respectively.

When a downward force is applied on the control lever 21 of the operation device 2, the first pivot seat 20 and the second pivot seat 22 are pressed to move downward, and the lower end of the second pivot seat 22 is moved downward to press the press piece 330 of the cover plate 33 of the switch device 3, so that the press piece 330 is moved downward to press the contact plate 32 so as to press and move the central portion of the contact plate 32 to contact the second contact point 310 of the contact terminal 31 to operate the switch device 3.

After the downward force applied on the control lever 21 of the operation device 2 is removed, the first pivot seat 20 and the second pivot seat 22 are pushed upward and returned to the original position by the restoring force of the spring 40, so that the contact plate 32 is returned to the original position by its elasticity, thereby detaching the contact plate 32 from the second contact point 310 of the contact terminal 31.

Accordingly, the spring 40 has a first end mounted on the mounting seat 410 of the urging race 41 and a second end mounted on the flange 303 of the base 30, so that the volume of the rocker lever assembly is reduced largely. In addition, the contact slide 52 is displaced on the resistance plate 502 of the casing 50 by guidance of the drive member 51, thereby greatly enhancing the sensitivity of each of the two sensing variable resistors 5. Further, the first pivot seat 20 and the second pivot seat 22 are made of wear-resistant metallic material, thereby enhancing the lifetime of the operation device 2. Further, the switch device 3 is hidden in the housing 1, thereby reducing the volume of the rocker lever assembly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A rocker lever assembly, comprising:

a housing;

an operation device mounted in the housing and including a first pivot seat pivotally mounted in the housing, a second pivot seat pivotally mounted in the housing and located under the first pivot seat, and a control lever mounted on the first pivot seat and the second pivot seat to pivot the first pivot seat and the second pivot seat; and a switch device mounted in the housing and including:

a base mounted in the housing and having an inside formed with a circular recess having a bottom formed with an annular protruding flange;

a contact terminal embedded in the flange of the base and including two spaced first contact points exposed from the flange of the base and a second contact point located between the first contact points and exposed from the flange of the base;

a contact plate flexibly mounted in the flange of the base and having a periphery rested on the first contact points of the contact terminal and a central portion spaced from the second contact point of the contact terminal; and a cover plate mounted on the flange of the base and having a central portion formed with an elastic press piece rested on the central portion of the contact plate to press the central portion of the contact plate to contact the second contact point of the contact terminal;

wherein the control lever is depressed to cause an under surface of the second pivot seat to depress the cover plate.

2. The rocker lever assembly in accordance with claim 1, further comprising a restoring device mounted in the housing and including an urging race rested on a bottom of the first pivot seat of the operation device, and a spring urged between the urging race and the base of the switch device.

3. The rocker lever assembly in accordance with claim 2, wherein the urging race of the restoring device has a side formed with a protruding mounting seat, and the spring has a first end mounted on the mounting seat of the urging race and a second end mounted on the flange of the base.

4. The rocker lever assembly in accordance with claim 1, wherein the contact terminal of the switch device is integrally coated by the flange of the base.

5. The rocker lever assembly in accordance with claim 1, wherein the contact terminal of the switch device has a side protruding outward from the base and formed with two spaced solder legs.

6. The rocker lever assembly in accordance with claim 1, wherein the housing includes a top plate, two adjacent first side plates each formed with an opening facing downward, and two adjacent second side plates each formed with an opening facing downward, the first pivot seat of the operation device has a first end formed with a first pivot shaft pivotally mounted in the opening of a first one of the two first side plates of the housing and a second end formed with a second pivot shaft pivotally mounted in the opening of a first one of the two second side plates of the housing, the second pivot seat of the operation device has a first end formed with a first pivot axle pivotally mounted in the opening of a second one of the two first side plates of the housing and a second end formed with a second pivot axle pivotally mounted in the opening of a second one of the two second side plates of the housing, and the rocker lever assembly further comprises two sensing variable resistors each mounted on the housing and each including:

a casing secured on a respective one of the two second side plates of the housing and having an inside formed with a mounting recess integrally formed with a resistance plate;

a drive member rotatably mounted in the casing and secured on a respective one of the second pivot shaft of the first pivot seat and the second pivot axle of the second pivot seat to rotate therewith; and a contact slide secured on the drive member to rotate therewith and movably mounted on the resistance plate of the casing along a curved track.

7. The rocker lever assembly in accordance with claim 6, wherein the resistance plate of each of the two sensing variable resistors has three terminal legs protruding outward from the casing.

8. The rocker lever assembly in accordance with claim 6, wherein each of the two second side plates of the housing is formed with two spaced locking holes, and the casing of each of the two sensing variable resistors is formed with two spaced hook-shaped elastic insertion legs each snapped into and locked in a respective one of the looking holes of the respective second side plate of the housing.

9. The rocker lever assembly in accordance with claim 6, wherein the casing of each of the two sensing variable resistors has a side formed with a mounting hole, and the drive member of each of the two sensing variable resistors has a first side formed with a counterbore mounted on a respective one of the second pivot shaft of the first pivot seat and the second pivot axle of the second pivot seat and a second side formed with a support shaft rotatably mounted in the mounting hole of the casing.

10. The rocker lever assembly in accordance with claim 9, wherein the second side of the drive member of each of the two sensing variable resistors has a periphery formed with a plurality of protruding stubs, and the contact slide of each of the two sensing variable resistors has a periphery formed with a plurality of through holes mounted on the protruding stubs of the drive member.

11. The rocker lever assembly in accordance with claim 6, wherein the contact slide of each of the two sensing variable resistors has a substantially crescent shape.

12. The rocker lever assembly in accordance with claim 6, wherein the base of the switch device has a peripheral wall formed with four opposite support studs for supporting the first pivot shaft and second pivot shaft of the first pivot seat and the first pivot axle and second pivot axle of the second pivot seat.

13. The rocker lever assembly in accordance with claim 6, wherein the two first side plates and the two second side plates of the housing are bendable.

14. The rocker lever assembly in accordance with claim 1, wherein the first pivot seat has an inside formed with a guide slot, and the control lever of the operation device is slidably mounted in the guide slot of the first pivot seat and has a first end protruding outward from the guide slot of the first pivot seat.

15. The rocker lever assembly in accordance with claim 1, wherein the second pivot seat of the operation device has an inside formed with a receiving chamber and has two side walls formed with two shaft holes each communicating with the receiving chamber, the control lever of the operation device has a second end pivotally mounted in the receiving chamber of the second pivot seat and formed with a pivot hole, and the operation device further includes a pivot pin extended through the two shaft holes of the second pivot seat and the pivot hole of the control lever, so that the control lever is pivotally mounted on the second pivot seat.

16. The rocker lever assembly in accordance with claim 1, wherein the top plate of the housing is formed with an operation hole for mounting the operation device.

17. The rocker lever assembly in accordance with claim 1, wherein the first pivot seat of the operation device has an arch shape.

18. The rocker lever assembly in accordance with claim 1, wherein the second pivot seat of the operation device is rotatable along a direction perpendicular to that of the first pivot seat.

* * * * *